United States Patent [19]

Kohle et al.

[11] 4,427,739

[45] Jan. 24, 1984

[54] MULTIUSE PRESSURE-TYPE REPRODUCTION MATERIAL

[75] Inventors: Ulrich Kohle, Burgdorf; Hans Paffhausen; Claus Hartmann, both of Hanover, all of Fed. Rep. of Germany

[73] Assignee: Pelikan Aktiengesellschaft, Hanover, Fed. Rep. of Germany

[21] Appl. No.: 374,037

[22] Filed: May 3, 1982

[30] Foreign Application Priority Data

May 9, 1981 [DE] Fed. Rep. of Germany ..... 3118980

[51] Int. Cl.[3] ..... B41M 5/02; B41M 5/10

[52] U.S. Cl. ..... 428/323; 282/28 R; 106/23; 427/153; 428/207; 428/321.3; 428/331; 428/488; 428/914

[58] Field of Search ..... 427/153; 428/207, 488, 428/914; 282/28 R, 27.5; 106/20, 22, 23, 27, 28

[56] References Cited

U.S. PATENT DOCUMENTS

| | | | |
|---|---|---|---|
| 2,864,720 | 12/1958 | Maguire et al. | 106/27 |
| 4,238,549 | 12/1980 | Dapp et al. | 427/153 |
| 4,260,664 | 4/1981 | Dapp et al. | 427/153 |

*Primary Examiner*—Bruce H. Hess

*Attorney, Agent, or Firm*—Karl F. Ross; Herbert Dubno

[57] ABSTRACT

A multiuse carbon transfer material, e.g. a carbon "paper" or carbon ribbon has a synthetic resin support film or foil having a coating which contains, in addition to a synthetic resin binder, a coloring agent of an oil base type. The oil forming the base for this coloring agent is a polyoxyethylene tenside which forms a plasticizer for the synthetic resin material of the binder.

6 Claims, No Drawings

MULTIUSE PRESSURE-TYPE REPRODUCTION MATERIAL

FIELD OF THE INVENTION

The present invention relates to a multiuse pressure-type reproduction material and, more particularly, to so-called multicarbon material capable of transferring a type or other impact impression to a copy sheet underlying this material.

BACKGROUND OF THE INVENTION

The term "reproduction material" is used herein to refer to a sheet-like material which, upon impact or subjection to pressure, is capable of transferring pigment to an underlying copy layer. Such materials, in sheet form, have commonly been referred to as carbon paper and have been available in single-use or multiuse form. The single-use carbon paper is discarded after use while the multiuse carbon paper is capable of being subjected to numerous impressions, each of which is capable of transferring a portion of the pigment on the surface opposite the impact face to successive sheets. Such materials are also available as so-called carbon ribbons, i.e. strips of film provided with a pigmentatious layer and passed between the platen and the type faces of a typewriter or other printing device.

In recent years, such materials have relied more heavily upon synthetic resin films as pigment carriers and thus, to an extent, the term "paper" is a misnomer.

The multicarbon materials with which the present invention is concerned, therefore, are such print-transfer materials as utilize a foil as the pigmentatious-layer carrier and can be in the form of sheets, ribbons or the like. The pigmentatious layer is applied in multiuse or multicarbon materials to the carrier foil in the form of a color-release coating which comprises a synthetic resin matrix in which the pigmentatious agent is displaced.

This pigmentatious agent can be a coloring substance such as a dye or a pigment in an oil phase so that it is, in effect, a colored oil which is not capable of solubilizing and is not soluble in the synthetic resin matrix.

To produce this layer, a solution of the matrix synthetic resin in a solvent is formed, this solvent also constituting a solvent for the colored oil. The solution is applied to the carrier foil and upon evaporation of the solvent, the oil is found to be disposed in numerous practically mutually communicating microdroplets embedded in the synthetic resin matrix.

Upon impact, some of the oil is transferred to the copy sheet in the region of the impact to form a copy of the impression and colored oil can refill the pores from which the transferred oil has been driven out.

Such multicarbon materials thus have a spongy layer filled with the coloring agent and from which the coloring agent is transferred to the copy sheet by force of the typewriter character or other printing impression.

An important disadvantage of earlier multicarbon materials of this type is the relatively low yield of the material. In other words, while the material is intended to produce a number of copies, in practice even after a few uses the transferred impression can be seen to be faded by comparison with the actual impression. Repeated impacts at the same location rapidly deplete the pigmentatious material in this region so that the copy after only a few uses is poor. The transfer material must then be discarded.

The problem is even more pronounced with so-called carbon ribbons since strike-overs at a single location are even more common and it is possible that even after a single passage through the machine, some regions of the ribbon may have been overstruck several times. As a result, on the return pass of the ribbon, the typewritten result is of poor quality. Clearly repeated uses of the ribbon suffer this problem even more markedly and the problem is still further pronounced in rapidly operating automatic printers, computer-associated and word processing equipment.

Ribbon changing is often a time-consuming and complex operation which interferes with the continuous operation of the machine. The problem has been traced in part to the fact that the concentration of oil droplets in the synthetic resin matrix cannot be made as high as is desired because increasing concentrations are detrimental to the stability of the synthetic resin matrix and prevent it from satisfactorily withstanding impact.

As a practical matter, therefore, the amount of coloring matter which can be contained in a unit area of the color transfer layer is limited. Furthermore the desired degree of intercommunication between the individual droplets may not materialize because of this limitation in the concentration of the oil droplets so that depleted vacuoles or pores in the synthetic resin matrix may not be replenished from adjacent vacuoles or pores.

The prior art materials have other disadvantages which are also significant. For example, it is difficult to bond the pigmentatious layer sufficiently firmly and uniformly to the carrier foil. This is because the pigmentatious layer has its pores not only open toward the copy sheet or paper but also open toward the carrier force and as a result of impact the oil is pressed from these pores and tends to penetrate between the foil and the matrix layer. With increasing uses, therefore, the spread of the oil film between the pigmentatious layer and the foil reduces the bonding of the matrix layer to the foil. Increasing the use, folding, creasing, and other factors which may interfere with effective bonding can cause large portions of the pigmentatious layer, in flakes or larger sections, to ablate from the foil.

Because of this problem it has been proposed to provide intermediate layers between the pigmentatious layer and the foil to serve as bonding layers or adhesion-increasing layers.

The application of such adhesion-promoting coatings to the foil requires an added step in the production of the material and hence results in an increse of the cost thereof.

Furthermore, the use of such intermediate layers is not free from problems. For example, the intermediate layer must have a high elasticity and itself possess good adhesion to both the carrier foil and to the pigment coating. It also must have high internal cohesion. It also must be of a composition such that it is not attacked by the solvent during the application of the pigmentatious layer.

In addition, this intermediate layer must be of a composition such that it does not permit migration of the color-carrying oil out of the pigmentatious layer.

In practice, no universally acceptable intermediate layer has been developed heretofore and hence for each carrier foil, matrix material composition and pigmented oil experiments must be undertaken to develop satisfactory intermediate layers. Frequently these intermediate layers must be so expensive that their use in multicarbon materials for the purposes described is barred by practical consideration.

OBJECTS OF THE INVENTION

It is the principal object of the present invention to provide a multiuse color-transfer print-reproduction material whereby the disadvantages of earlier materials are obviated.

Another object of this invention is to provide a multicarbon material for the purposes described which has a longer life (in terms of number of uses) and hence provides a greater output, is free from the tendency for the pigmentatious layer to separate from the carrier foil, and is of lower cost than the high quality multicarbon materials utilized or proposed heretofore

DESCRIPTION OF THE INVENTION

These objects and others which will become apparent hereinafter are attained in a multiuse compression-transfer material based upon our surprising discovery that no intermediate layer is required and adhesion between the matrix layer and the carrier foil can be markedly improved when the oil base of the coloring agent is constituted by a surface acting agent or tenside containing polyoxyethylene groups and which simultaneously constitutes a softener or plasticizer for the synthetic resin of the foil, the color-containing layer also containing a quantity of finely divided filler of high specific surface area and a particle size of 0.2 to 20 microns.

With the system of the invention, therefore, a high degree of adhesion can be obtained without the use of the intermediate layer, thereby invoking a clearly new principle for the structure of the reproduction material.

Firstly, the color-transfer layer no longer has the configuration of a spongy relatively rigid and coherent matrix of the synthetic resin binder in which the colored oil is dispersed as droplets which can be pressed out of the pores.

Instead, the color transfer layer appears to be constituted of only slightly coherent "dry" lamella which have practically no free oil droplets or at least no significant proportion of free oil droplets so that, upon impact, ultrathin layer by ultrathin layer the color carrying material is locally lifted from the coating and transferred to the copy paper.

The layer which is transferred can be as thin as a monomolecular layer and thus it may be presumed that the combination of features mentioned previously, namely the specific tenside and the particle size range of the filler, impart a tendency to the color transfer layer to release upon impact against the copying paper in only such extremely thin and substantially dry layers.

It must be observed that the instant invention is not an attempt to improve upon the sponge structure color transfer layers provided heretofore. Indeed it uses an entirely different approach in which the color-carrying oil functions as a compatible plasticizer for the foil and effectively makes the surface of the foil in contact with the color layer sticky or tacky and thus able to retain the color-transfer coating. The latter, because of the highly absorbent filler with high specific surface area, is practically dry and bonds well to the tacky surface. However its low internal cohesion permits thin-layer transfer as previously noted.

The color transfer covering, therefore, has exceptionally effective adhesion to the carrier foil which is not adversely effected by the pressing of oil between the color transfer layer and the foil. The color transfer layer of the system of the invention simply contains no free oil which could be pressed between it and the foil. The adhesion originally imparted thus remains over the life of the copy material and in spite of multiple use and such effects as creasing, folding, wrinkling and the like.

The adhesion phenomena in the copy material of the invention are thus stopped so that, for example, the greatest adhesion (adhesive force) is between the color transfer layer and the foil. The next greatest is the adhesion of the transferred color layer to the paper and the smallest is the interparticle adhesion or internal cohesion of the color transfer layer.

It has been found, surprisingly, that these staggered adhesive forces can be obtained when the coloring agent is an oil base coloring agent, and the oil forming the base includes or is constituted by a liquid or pasty tenside or surfactant containing polyoxyethylene groups, preferably polyoxyethylene alkyl ethers and polyoxyethylene esters of fatty acids and resinic acids.

Particularly effective results are also obtained with polyoxyethylene alkyl phenol ethers of the type marketed, for example, under the name RENEX (ICI United States Inc., Wilmington, Del.).

Other nonionic liquid to pasty tensides containing polyoxyethylene groups and mixtures of them, including mixtures of solid and liquid tensides, are effective as well.

The color transfer layer also contains a synthetic resin binder and practically all binders which have hitherto been utilized for multicarbon materials have been found to be effective. These include polyacrylates, polyvinylchloride and acetate mixpolymers, linear polyesters, polyvinyl acetates and polystyrenes as well as copolymers or mixpolymers containing same.

The tensides which are used can be tested empirically and simply to determine suitability. The following requisites can be used as a guide:

Firstly, they should be soluble or capable of forming a colloidal suspension in the solvent in which the binder is to be dissolved.

Secondly, they should be capable of constituting a true plasticizer or softener for the binder, i.e. a plasticizer or softener that does not bleed from the copy material even with storage.

Thirdly, they should be miscible with the binder in such proportions that the mixture is maintained in a viscoelastic state and has a tacky character after solvent evaporation (drying).

In practice, a mixture of the binder and softener should contain both in such relationship in the solvent that, when the solvent is evaporated, the resulting product is a tacky viscoelastic material. The mixture to be deposited upon the foil thus should also include coloring agents and pigments as well as the aforementioned filler in the essential particle size range between 0.2 and 20 microns, this filler being a highly absorptive inorganic material such as diatomaceous earth. Other fillers can include active carbon, crushed microspheres or other materials having a surface penetrable by the color-carrying oil or accessible to the latter.

The proportions should be such that the critical pigment or volume concentration which normally determines the internal cohesion of the layer can be substantially exceeded.

The carrier foil can be any of the polymer materials hitherto used for multicarbon materials, such as polyesters, polypropylenes or polyamides. The mixture is coated onto the carrier foil in the solvent and after evaporation of the solvent has the configuration of a color-transfer layer which is mixed to the foil and because of the residual, tacky character and low internal cohesion, impressions are transferred to the copy sheet in the ultrathin layers previously described.

The best tensides for the purposes of the present invention are those which have a high tendency to solubilize fat-soluble coloring agents or dyestuffs, i.e. dyestuffs, and which also have high dispersibility with respect to finely divided solids such as pigments and fillers.

The preferred fatty dyestuffs are triarylmethane dyestuffs especially Sudan Deep Black and Neozapon Fire Red (also known as solvent dyes).

One of the important advantages of this invention is that such dyes are generally soluble to concentrations of less than 1% in the oil bases hitherto utilized in multicarbon materials.

By comparison, the coloring agent of the present invention may contain such dyes in a concentration of 50 to 80% and the solubility of dyes in the polyoxyethylene increases as the length of the polyoxyethylene chain increases.

Because of the high concentration of dyestuff in the oil and hence in the color-transfer layer, the thin film which is transferred to the copy sheet has a high color density in spite of the fact that very little material is actually transferred. In other words, the concentration of color in the material which is transferred is so high as to overcome any disadvantages which might be expected from the small amount of material transferred at each impression.

Furthermore because the amount of material which is transferred at each impression is small, the copy material can be used for a large number of high quality impressions.

Another important advantage of this invention is that even after numerous impressions, the transferred print does not significantly fade or suffer a loss of intensity. This is because the transfer of material from the uppermost layer to the lowermost layer of the color-transfer coating is substantially uniform, at least with respect to the distribution of the dyestuff whereas in earlier systems, a fading was noticeable after several impressions because of the inability of pores to be replenished.

For each impression, therefore, a new layer is exposed which is transferred at the next impression.

The proportions of the various components in the mixture deposited upon the substrate are the following:

synthetic resin binder (in solid form): 2 to 6% by weight, preferably 3 to 5% by weight polyoxyethylene tenside: 10 to 30% by weight, preferably 15 to 25% by weight solvent dye: 5 to 10% by weight, preferably 6 to 9% by weight pigment: 0 to 10% by weight, preferably 4 to 8% by weight filler: 10 to 25% by weight, preferably 15 to 20% by weight solvent (total): 30 to 60% by weight, preferably 35 to 50% by weight.

The solvent, of which a portion is generally provided in the form of a carrier for the binder (for example a 20% solution of the binder in the solvent), is evaporated and hence no longer to be found in the finished product after drying. The percents given above, with the exclusion of the proportion of the solvent, can therefore also be read as parts by weight of the color transfer composition after drying.

The following examples are illustrative of the invention. In all cases, the substrate was a polyester foil ranging in thickness from 6 to 30 microns. The solution of suspension was coated upon the foil and then dried. The thickness of the coating in the dried form was 20 to 40 microns.

EXAMPLE 1

To form a black transfer material for copying purposes utilizing a typewriter and free from carbon black the following composition was prepared:

| | | |
|---|---|---|
| 1.1 | celluloseacetobutyrate | 4.88% |
| | polyoxyethylenenonylphenolether | 14.63% |
| | fatty dyestuff - black | 9.75% |
| | diatomaceous earth | 21.96% |
| | methylethylketone | 48.78% |
| | | 100.00% |

The coating was applied to the polyester foil in an amount of 20 to 30 grams per $m^2$ without an intermediate layer and continuously, and dried. Tests were made of the product as a substitute for a carbon ribbon. On the average 100 strikeovers could be made without loss of intensity of the transfer and even after 300 strikeovers, complete elimination of the color at the strikeover site was not observed. With conventional multicarbon ribbons, even after 20 to 30 strikeovers, the ribbon becomes transparent and can no longer transfer significant amounts of color.

The following compositions have also been fabricated with similar results, except that they contain a smaller proportion of carbon black as a pigment:

| | | |
|---|---|---|
| 1.2 | celluloseacetobutyrate | 3.3% |
| | polyoxyethylenenonylphenolether | 11.1% |
| | polyoxyethylenestearate | 18.8% |
| | Fatty Dyestuff - Black | 8.2% |
| | carbon black | 4.8% |
| | diatomaceous earth | 18.6% |
| | methylethylketone | 35.2% |
| | | 100.0% |
| 1.3 | celluloseacetobutyrate | 3.6% |
| | polyoxyethylenenonylphenolether | 24.4% |
| | Fatty Dyestuff - Black | 8.8% |
| | carbon black | 5.1% |
| | diatomaceous earth | 20.0% |
| | methylethylketone | 38.1% |
| | | 100.0% |
| 1.4 | polyacrylate | 3.7% |
| | polyoxyethylenenonylphenolether | 21.1% |
| | Fatty Dyestuff - Black | 6.8% |
| | carbon black | 4.6% |
| | diatomaceous earth | 15.9% |
| | methylethylketone | 47.9% |
| | | 100.0% |

In all of the foregoing compositions all or part of the diatomaceous earth, having a particle size of 0.2 to 20 microns, can be replaced by active charcoal without altering the color transfer properties.

EXAMPLE 2

The following compositions are effective for the transfer of fluorescent color patterns or type:

| | | |
|---|---|---|
| 2.1 | celluloseacetobutyrate | 6.2% |

-continued

| | | |
|---|---|---|
| | polyoxyethylenenonylphenolether | 18.3% |
| | Fluorescent Dyestuff - Violet | 10.0% |
| | Fluorescent Dyestuff - Yellow | 8.0% |
| | diatomaceous earth | 18.9% |
| | isopropylalcohol/tuluol 1:1 | 38.6% |
| | | 100.0% |
| 2.2 | polystyrene | 4.7% |
| | polyoxyethylenenonylphenolether | 13.4% |
| | polyoxyethylenestearate | 16.2% |
| | Fluorescent Dyestuff - Red | 6.9% |
| | Fluorescent Pigment - Yellow | 5.9% |
| | diatomaceous earth | 17.2% |
| | methylethylketone | 35.7% |
| | | 100.0% |
| 2.3 | polystyrene | 4.7% |
| | polyoxyethylenetridecylether | 13.4% |
| | polyoxyethylenestearate | 16.2% |
| | Fluorescent Dyestuff - Red | 6.9% |
| | Fluorescent Pigment - Yellow | 5.9% |
| | diatomaceous earth | 17.2% |
| | methylethylketone | 35.7% |
| | | 100.0% |
| 2.4 | polyvinylacetate | 4.9% |
| | polyoxyethylenetetradecylether | 15.7% |
| | Fluorescent Dyestuff - Red | 7.8% |
| | Fluorescent Pigment - Yellow | 6.2% |
| | diatomaceous earth | 18.1% |
| | methylethylketone | 47.3% |
| | | 100.0% |
| 2.5 | celluloseacetobutyrate | 4.9% |
| | polyoxyethylenenonylphenolether | 15.7% |
| | Fluorescent Dyestuff - Red | 7.8% |
| | Fluorescent Dyestuff - Yellow | 6.2% |
| | polyamide wax (filler) | 18.1% |
| | methylethylketone | 47.3% |
| | | 100.0% |

Fluorescent color transfer typewriter ribbon was produced with all of the aforementioned compositions and the improvement in the number of times which the ribbon could be used was manifold increased over conventional typewriting ribbons for fluorescent transfer.

EXAMPLE 3

The following composition is effective for red impressions (as carbon paper or ribbon):

| | |
|---|---|
| celluloseacetobutyrate | 6.3% |
| polyoxyethylenenonylphenolether | 17.0% |
| Fatty Dyestuff - Red | 11.4% |
| diatomaceous earth | 25.0% |
| methylethylketone | 40.3% |
| | 100.0% |

EXAMPLE 4

The following example relates to a transfer of print having a magnetic effect

| | |
|---|---|
| celluloseacetobutyrate | 6.0% |
| Polyoxyethylenenonylphenolether | 13.8% |
| magnetic pigment (iron oxide) | 30.4% |
| diatomaceous earth | 6.0% |
| methylethylketone | 63.8% |
| | 100.0% |

The result is a multiuse magnetic typewriter ribbon which allows at least six uses by comparison with the single use magnetic ribbons hitherto employed.

We claim:

1. A multiuse material for the transfer of an impression onto a copy sheet, comprising:

a synthetic resin foil substrate; and a color-transfer coating on said substrate, said coating comprising:

a synthetic resin binder, a coloring agent distributed in said binder, said coloring agent including a dyestuff, a pigment or a mixture thereof, at least one nonionic tenside containing polyoxyethylene groups forming a vehicle for the dyestuff, pigment or mixture and constituting a plasticizer for the synthetic resin of said binder, said tenside being mixed with said binder in such proportion that the coating is maintained in a visco-elastic state and has a tacky character, and a filler distributed in said coating and having a high specific surface area and a particle size in the range of 0.2 to 20 microns.

2. The material defined in claim 1 wherein said tenside is selected from the group which consists of polyoxyethylenealkylethers, polyoxyethylene esters of fatty acids and resin acids, polyoxyethylenealkylphenolethers, and mixtures thereof.

3. The material defined in claim 1 or claim 2 wherein said filler is selected from the group which consists of diatomaceous earth, active carbon, crushed microspheres or mixtures thereof.

4. The material defined in claim 3 wherein said coating consists essentially of 2 to 6 parts by weight of said binder, 10 to 30 parts by weight of said tenside, up to 10 parts by weight of a pigment, up to 10 parts by weight of a dyestuff which is soluble in said tenside and 10 to 25 parts by weight of said filler.

5. The material defined in claim 4 wherein said dyestuff is present in said coating in an amount of 5 to 10 parts by weight.

6. The material defined in claim 5 wherein said binder is present in an amount of 3 to 5 parts by weight of said coating, said tenside is present in an amount of 15 to 25 parts by weight of said coating, said dyestuff is present in an amount of 6 to 9 parts by weight of said coating and said filler is present in an amount of 15 to 20 parts by weight of said coating.

* * * * *